United States Patent [19]

Bhandari et al.

[11] 4,101,562

[45] Jul. 18, 1978

[54] TREATMENT OF SAPONIFIED SYNTHETIC FATTY ACIDS

[75] Inventors: Ashok Kumar Bhandari; Shrinath Sheshgiri Kalbag, both of Bombay, India

[73] Assignee: Lever Brothers Company, New York, N.Y.

[21] Appl. No.: 764,970

[22] Filed: Feb. 2, 1977

[30] Foreign Application Priority Data

Feb. 10, 1976 [GB] United Kingdom ..... 5123/76

[51] Int. Cl.[2] ..... C11C 1/08

[52] U.S. Cl. ..... 260/419; 260/428.5

[58] Field of Search ..... 260/412.8, 418, 419, 260/428.5

[56] References Cited

U.S. PATENT DOCUMENTS

| | | | |
|---|---|---|---|
| 2,318,749 | 5/1943 | Buxton et al. | 260/418 |
| 2,380,413 | 7/1945 | Buxton | 260/418 |
| 2,564,409 | 8/1951 | Rubin | 260/412.8 |
| 2,744,125 | 5/1956 | Meeks et al. | 260/412.8 |
| 2,752,377 | 6/1956 | McDonald | 260/412.8 |
| 3,872,142 | 3/1975 | Saito et al. | 260/418 |

*Primary Examiner*—Winston A. Douglas
*Assistant Examiner*—John F. Niebling
*Attorney, Agent, or Firm*—James J. Farrell; Melvin H. Kurtz; Michael J. Kelly

[57] ABSTRACT

Unsaponifiable material is extracted from saponified synthetic fatty acids by treatment with a chlorinated hydrocarbon. The treatment is performed above about 70° C at a pressure sufficient to ensure the hydrocarbon does not boil. The reactants settle into two layers without emulsification with the unsaponifiables contained in the lower chlorinated hydrocarbon layer.

7 Claims, No Drawings

TREATMENT OF SAPONIFIED SYNTHETIC FATTY ACIDS

This invention relates to synthetic fatty acids and particularly to acids prepared by the oxidation of long chain paraffins containing from about 10 to about 35 carbon atoms. The paraffins are liquid up to about $C_{26}$ and form waxy solids above that chain length. Paraffins subjected to oxidation to prepare synthetic fatty acids will usually contain from about 10 to about 25 carbon atoms. This invention is particularly directed to the removal of unsaponifiable material from the fatty acids.

A problem found in general with synthetic fatty acids is the removal of unsaponifiable material. This removal process is performed on the saponified material, which hereafter will be referred to as "soap", and a number of processes are known for effecting this removal. Saponification will be performed using a material, for example a hydroxide, providing the sodium, potassium or ammonium salts of the synthetic fatty acid, or mixture thereof.

U.S. Pat. No. 3,872,142 describes the use of solvent extraction with ethylene dichloride in contact with an alcholic solution of the soap. The present invention is a solvent extraction process which reduces the number of solvents which have to be used in the process.

The present invention is a method of extracting unsaponifiable material from soap by:

(i) contacting an aqueous solution of the soap with a water miscible solvent free chlorinated hydrocarbon containing from 2 to 4 carbon atoms in amounts of from about 10:1 to about 1:10 by weight, preferably from about 3:1 to about 1:3, at a temperature of from about 70° C to about 200° C under pressure sufficient to retain the chlorinated hydrocarbon below its boiling point;

(ii) settling the total reactants into two layers, while retaining the necessary pressure;

(iii) separating the lower chlorinated hydrocarbon layer which contains the unsaponifiable material; and (iv) recovering soap from the upper layer.

The synthetic fatty acids can be recovered if desired by splitting the purified soap using standard procedures. The preferred chlorinated hydrocarbon is ethylene dichloride (1:2 dichloro-ethane) but trichloroethylene can also be used. Preferably the temperature is above about 80° C and preferably below about 100° C. A soap solution may be subjected to more than one treatment with chlorinated hydrocarbons. The concentration of the soap solution treated is not critical but will be chosen having regard to economic operation of the method.

In the absence of a water-miscible solvent contact between the soap solution and the chlorinated hydrocarbon leads to formation of a stable emulsion which cannot be separated into its constituents in the form of layers. The invention lies in the finding that when the extraction is carried out at a temperature above the normal boiling point of the solvent under pressures sufficiently high to prevent boiling, the formation of a stable emulsion is avoided. Examples of methods of producing the desired pressures are by hydraulic pressure or by having sufficient inert gas (preferably nitrogen) in the headspace of the pressure vessel.

Elimination of the water-miscible solvent from the separation process reduces the cost thereof by reducing solvent loss, requires a simpler solvent recovery system, and makes removal of solvent from the soap and its re-use easier. An Example of the process according to the invention will now be given.

EXAMPLE

Extraction under pressure was carried out in a 50 liter vessel. The vessel is provided with a turbine agitator operating at about 500 rpm. The vessel could stand pressure up to 200 pounds per sq.in. and it was connected to a nitrogen cylinder. The vessel is fitted with a cooling coil and vessel contents can be heated by passing steam in the jacket. Extraction was carried out at 88° C ± 2%) under pressure of 45–50 pounds per sq.in. To begin with when the vessel contents were at room temperature, a pressure of 25 pounds per sq.in. of nitrogen was applied. The material was then heated to 88° C when the pressure rose to 45–50 pounds per sq.in. During the settling period the pressure was maintained at the above level so that the material did not boil.

There was no provision for cooling the extract during discharging. Hence, the contents of the vessel were cooled to below 70° C before releasing the pressure. The extract which forms the lower layer was then removed. After two extractions, soap was desolventised by passing live steam. Unsaponified material was recovered from extract in a (batch) differential distillation set up.

In one such extraction experiment 10 kg of soap stock was diluted with 7.0 kg water. The diluted soap stock contained 27.4% fatty matter and about 35% unsaponified material on fatty matter. This soap was extracted twice with 14.0 kg and 22.8 kg fresh ethylene dichloride (EDC) respectively. 8.3 kg first extract and 22.4 kg of second extract was discharged. Extracted soap (19.6 kg) was concentrated to remove EDC. The fatty matter from soap showed Acid Value 171 mgKOH/g, Saponification Value 208 mgKOH/g and unsaponified material 6.6%. The EDC was recovered by distillation and the unsaponifiable material water washed and recycled.

What is claimed is:

1. A method of extracting unsaponifiable material from saponified synthetic fatty acids by (1) contacting an aqueous solution of the saponified synthetic fatty acids with a chlorinated hydrocarbon containing from 2 to 4 carbon atoms, said hydrocarbon being free of water miscible solvent and having a boiling point above about 70° C, in amounts of from about 10:1 to about 1:10 by weight, at a temperature above the normal boiling point of the chlorinated hydrocarbon to about 200° C and under a pressure sufficient to retain the chlorinated hydrocarbon below its boiling point;

(ii) settling the total reactants into two layers while retaining said sufficient pressure;

(iii) separating the lower chlorinated hydrocarbon layer which contains the unsaponifiable material; and (iv) recovering said saponified synthetic fatty acids from the upper layer.

2. A method according to claim 1, wherein step i) is performed at a temperature above about 80° C.

3. A method according to claim 1, wherein step i) is performed at a temperature below about 100° C.

4. A method according to claim 1, wherein the chlorinated hydrocarbon is ethylene dichloride.

5. A method according to claim 1, wherein the amounts of soap solution and chlorinated hydrocarbon are from about 3:1 to about 1:3.

6. A method according to claim 1, wherein a gas inert to the reactants is present to provide pressure.

7. A method according to claim 1, wherein the synthetic fatty acids are derived from long chain paraffins containing from about 10 to about 35 carbon atoms said acids being prepared by oxidation.

* * * * *